US008702386B2

(12) United States Patent
Lee et al.

(10) Patent No.: US 8,702,386 B2
(45) Date of Patent: Apr. 22, 2014

(54) FAN AND BLADE THEREOF

(75) Inventors: Sung-Wei Lee, Taoyuan Hsien (TW); Shun-Chen Chang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 2305 days.

(21) Appl. No.: 11/493,768

(22) Filed: Jul. 27, 2006

(65) Prior Publication Data

US 2007/0036651 A1 Feb. 15, 2007

(30) Foreign Application Priority Data

Aug. 12, 2005 (TW) ..... 94127414 A

(51) Int. Cl.
*F04D 29/54* (2006.01)

(52) U.S. Cl.
USPC ..... 415/211.2; 415/220

(58) Field of Classification Search
USPC ..... 415/211.2, 220, 208.1, 209.1, 199.4; 416/247 R, 237, 23
See application file for complete search history.

(56) References Cited

U.S. PATENT DOCUMENTS

| | | | | | |
|---|---|---|---|---|---|
| 1,887,417 | A * | 11/1932 | Mawson | 415/194 |
| 2,313,413 | A * | 3/1943 | Weske | 415/193 |
| 3,059,834 | A * | 10/1962 | Hausammann | 416/237 |
| 3,812,812 | A * | 5/1974 | Hurwitz | 416/205 |
| 4,364,712 | A * | 12/1982 | Charles | 416/183 |
| 4,618,313 | A * | 10/1986 | Mosiewicz | 416/237 |
| 6,206,635 | B1 * | 3/2001 | Golm et al. | 415/211.2 |
| 6,634,855 | B1 * | 10/2003 | Rollo | 415/206 |
| 6,796,858 | B2 * | 9/2004 | Dusablon et al. | 440/38 |
| 6,799,942 | B1 * | 10/2004 | Tzeng et al. | 415/61 |
| 6,899,521 | B2 * | 5/2005 | Horng et al. | 415/208.2 |
| 7,184,268 | B2 * | 2/2007 | Espinoza-Ibarra et al. | 361/695 |
| 2002/0094271 | A1 * | 7/2002 | Yeuan et al. | 415/211.2 |
| 2003/0156945 | A1 * | 8/2003 | Suzuki | 416/228 |
| 2003/0190234 | A1 * | 10/2003 | Huang | 416/228 |
| 2005/0025620 | A1 * | 2/2005 | Horng et al. | 415/211.2 |

FOREIGN PATENT DOCUMENTS

| | | | | |
|---|---|---|---|---|
| JP | 54146005 | A * | 11/1979 | |
| JP | 55040208 | A * | 3/1980 | F04D 25/08 |
| JP | 05141394 | A * | 6/1993 | |

OTHER PUBLICATIONS

JPO Machine Translation, JP05-141394A, accessed Aug. 6, 2009, pp. 1-5.*
Translation JP 55-040208. Feb. 2010. 9 pages. FLS, Inc. Washington D.C.*
Translation JP 54-146005. Feb. 2010. 10 pages. FLS, Inc. Washington D.C.*

* cited by examiner

*Primary Examiner* — Richard Edgar
(74) *Attorney, Agent, or Firm* — Birch, Stewart, Kolasch & Birch, LLP

(57) ABSTRACT

A fan includes a frame and an impeller. The impeller is disposed in the frame and the impeller has a plurality of blades. Each blade has a wing part and a flap part, and the wing part and the flap part form a predetermined angle. A blade is also disclosed.

12 Claims, 8 Drawing Sheets

FAN AND BLADE THEREOF

BACKGROUND OF THE INVENTION

1. Field of Invention

The present invention relates to a fan and a blade thereof, and more particularly to a fan and a blade thereof with a better airflow efficiency.

2. Related Art

As shown in FIG. 1, a conventional fan 1 includes a frame 11 and an impeller 12. The frame 11 has a shell 111 and a base 112. A plurality of ribs 113 are connected between the shell 111 and the base 112. Moreover, a motor (not shown) may be disposed in the base 112. The impeller 12 has a hub 121 and a plurality of blades 122 disposed around the hub 121. The impeller 12 is disposed in the base 112 of the frame 11 via the hub 121 and is driven by the motor to rotate with respect to the base 112. Therefore, each blade 122 enforces nearby air to produce airflow.

As shown in FIG. 2, the connection line between the leading edge L and the trail edge T of each blade 122 forms an installation-angle $\beta$ with the bottom surface of the impeller 12. The angle between the connection line and the airflow direction into each blade 122 (as indicated by the arrow) is defined as an attack-angle $\alpha^{\circ}$ In practice, the angle of the airflow entering the fan 1 changes with respect to the rotating speed of the fan 1, and then the attack-angle $\alpha$ is changed. Once the attack-angle $\alpha$ exceeds a critical angle, the airflow is separated from the surface of each blade 122, and a vortex is generated above each blade 122. In this situation, the airflow cannot be further increased even if the rotating speed of the fan 1 is raised. This is the so-called stalling phenomenon. Not only the airflow efficiency of the fan 1 cannot be enhanced, it also produces noises to waste the energy consumption of the fan 1 and the airflow efficiency is thus reduced.

It is thus imperative to provide a fan and a blade thereof to solve the above-mentioned problems.

SUMMARY OF THE INVENTION

In view of the foregoing, the present invention provides a fan and a blade thereof to prevent the stalling phenomenon from happening and to achieve better airflow efficiency.

To achieve the above, a fan according to the present invention includes a frame and an impeller. The impeller is disposed in the frame and has a plurality of rotor blades. Each rotor blade has a wing part and a flap part, and the wing part and the flap part form a predetermined angle, wherein the ratio of the axial length of the first flap parts to the axial length of the rotor blades is less than 0.75.

To achieve the above, another fan according to the present invention includes a frame and an impeller. The frame has a plurality of stationary blades. Each stationary blade has a wing part and a first flap part, and the wing part and the first flap part form a predetermined angle, wherein the ratio of the axial length of the first flap parts to the axial length of the stationary blades is less than 0.75. The impeller is disposed in the frame.

To achieve the above, yet another fan according to the present invention includes a frame, an impeller and a protecting cover. The frame has a plurality of wing parts. The impeller is disposed in the frame. The protecting cover is detachably assembled with the frame and has a plurality of flap parts respectively corresponding to the wing parts. The flap part and the wing part form a predetermined angle.

To achieve the above, yet another fan according to the present invention includes a frame and an impeller. The frame has a plurality of first flap parts. The impeller is disposed in the frame and has a plurality of rotor blades, wherein the rotor blade and the first flap part form a predetermined angle, wherein the ratio of the axial length of the first flap parts to the axial length of the rotor blades is less than 0.75.

According to the invention, a fan blade according to the present invention includes a wing part and a flap part. The flap part is connected to the wing part. The flap part and the wing part form a predetermined angle.

As mentioned above, due to the flap part is connected to the wing part, and the wing part and the flap part form a first predetermined angle. Comparing with the prior art, a fan and a blade thereof according to the present invention can enhance the airflow efficiency, prevent installing phenomenon from happening, and reduce the noises during operations. Moreover, in addition to the impeller of the fan, the structure of the wing part and the flap part can be disposed in the frame or protecting cover to enhance the airflow efficiency and the product quality.

BRIEF DESCRIPTION OF THE DRAWINGS

The present invention will become more fully understood from the detailed description given herein below illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
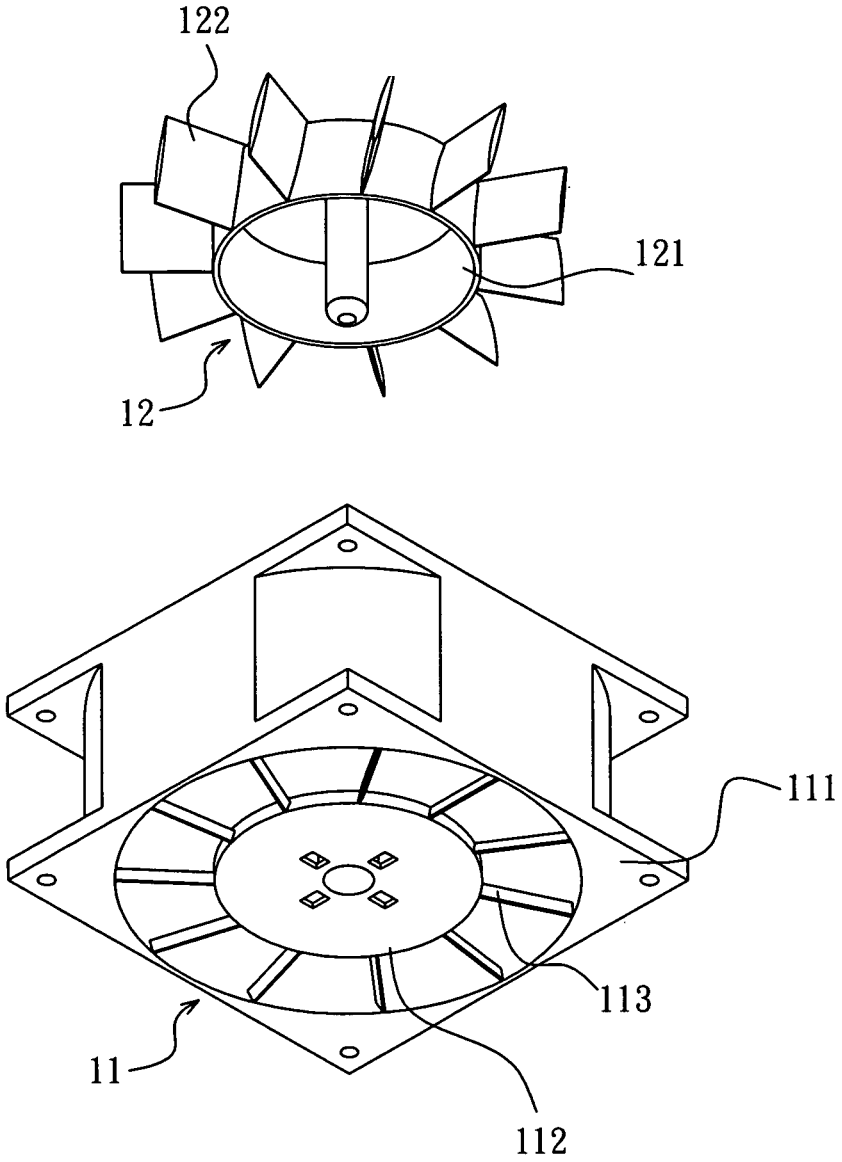
FIG. 1 (PRIOR ART)
FIG. 1 is a three-dimensional exploded view showing a conventional fan.
Figure 2:
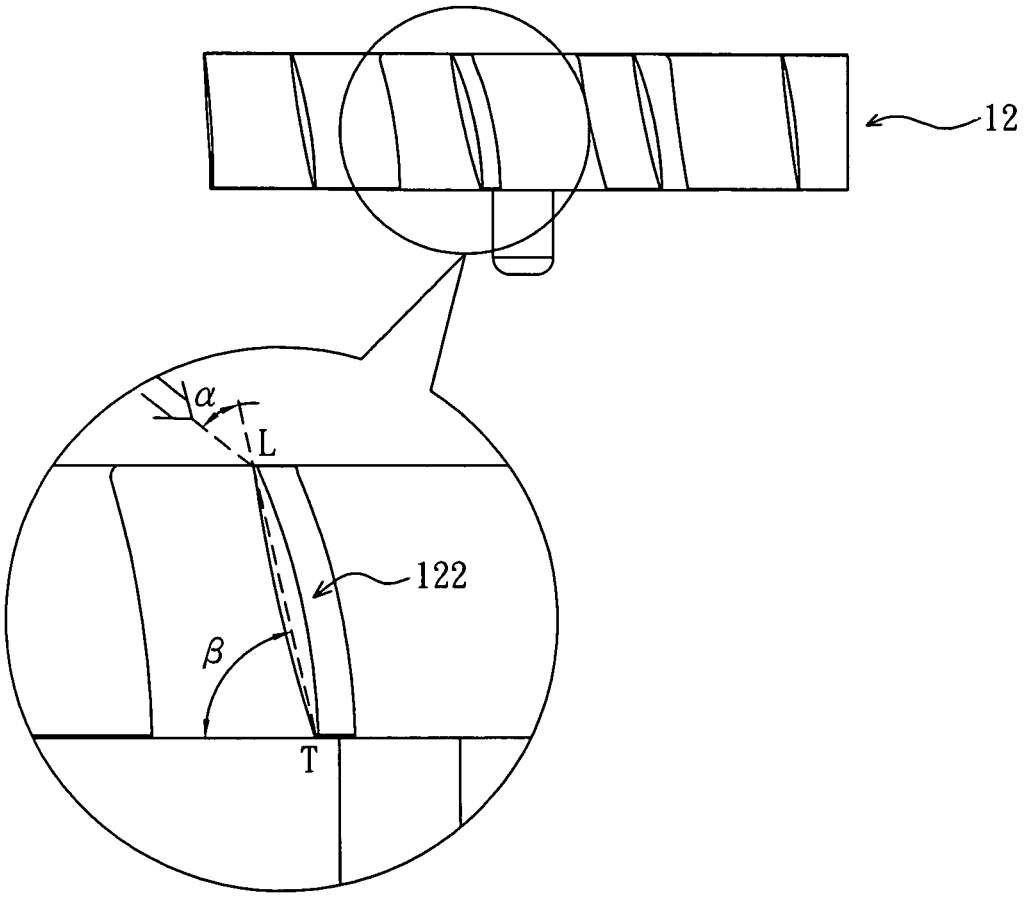
FIG. 2 (PRIOR ART)
FIG. 2 is a schematic view showing a conventional blade.
Figure 3:
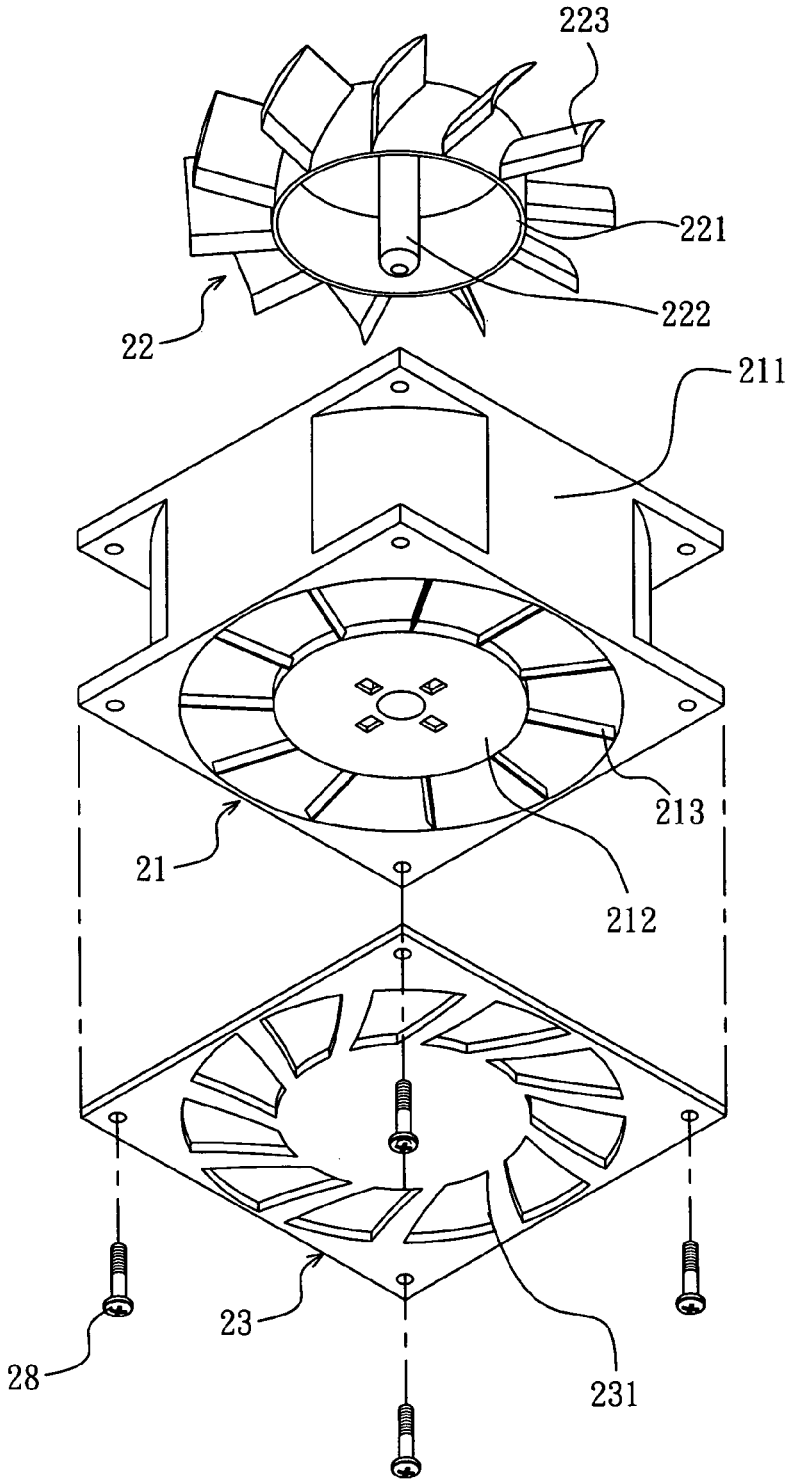
FIG. 3 is a three-dimensional exploded view showing a fan according to a first embodiment of the present invention.

As shown in FIG. 3, a fan 2 according to a first embodiment of the present invention includes a frame 21 and an impeller 22.

The frame 21 has a shell 211 and a base 212 inside. A plurality of stationary blades 213 or ribs are connected between the shell 211 and the base 212. In addition, a motor (not shown) may be disposed in the base 212.

The impeller 22 has a hub 221 and a plurality of rotor blades 223 disposed around the hub 221. The hub 221 has a shaft 222 pivoted in the base 212 of the frame 21. The impeller 22 is driven by the motor to rotate.

Figure 4:
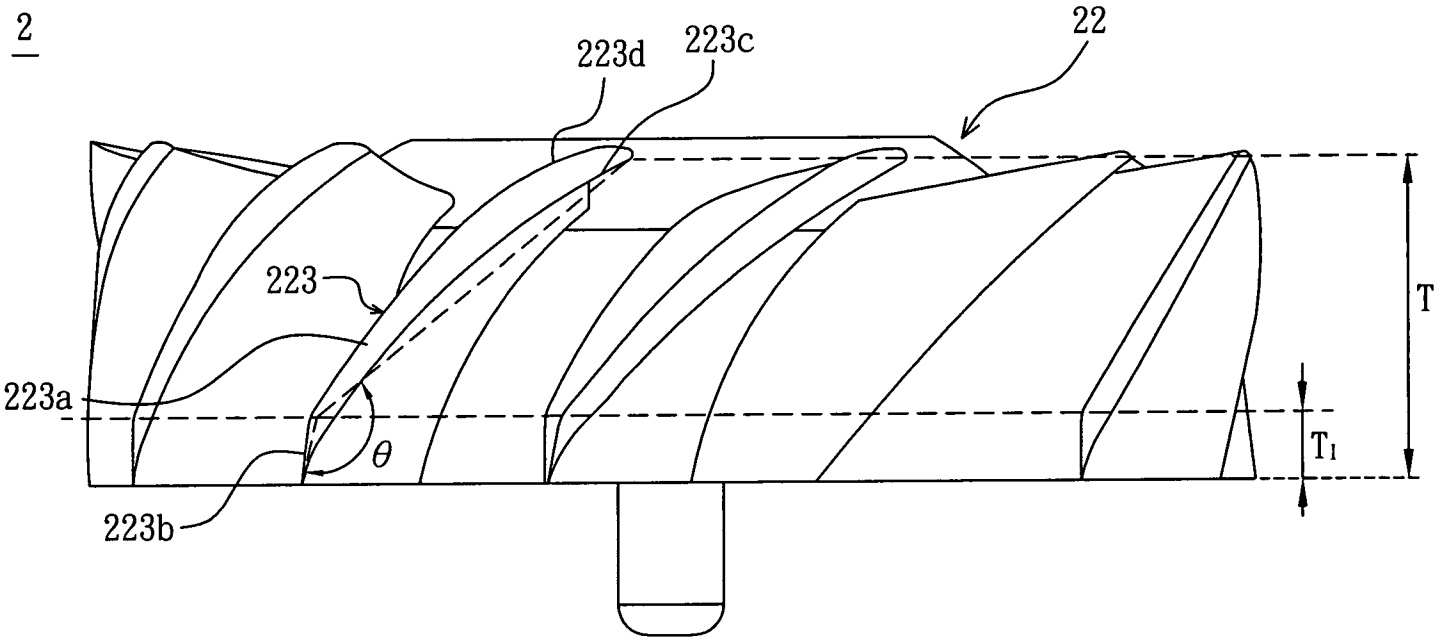
FIG. 4 is a schematic view showing another fan blade according to the first embodiment of the present invention.

As shown in FIG. 4, each rotor blade 223 has a wing part 223*a* and a flap part 223*b*, wherein the flap part 223*b* is as the extended part of the wing part 223*a* and the extended direction of the flap part 223*b* is different from that of the wing part 223*a*. The wing part 223*a* and the flap part 223*b* can be formed a complete wing. Each rotor blade 223 has a front surface 223*c* and a back surface 223*d*. A predetermined angle θ is formed by the wing part 223*a* and the flap part 223*b* at the position of the front surface 223*c*. In this embodiment, the predetermined angle θ is greater than 90 degrees. The ratio of the axial length $T_1$ of the flap parts 223*b* to the axial length T of the rotor blades 223 is less than 0.75. The flap part 223*b* is for example curved or flat.

Figure 5:
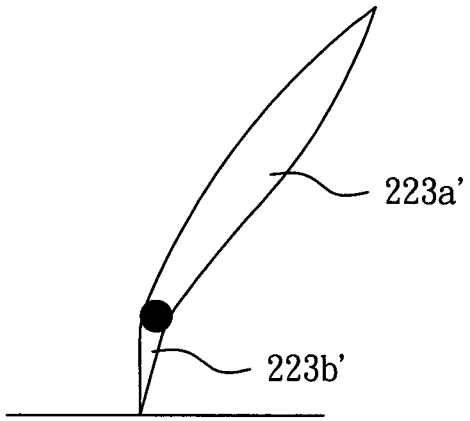
FIG. 5 is another schematic view showing the fan blade according to the first embodiment of the present invention.
Figure 6:
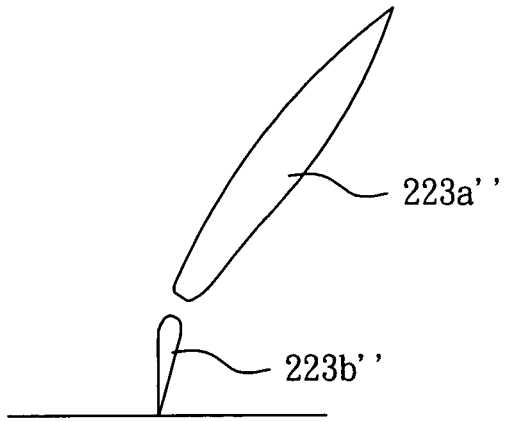
FIG. 6 is yet another schematic view showing the fan blade according to the first embodiment of the present invention.

In this embodiment, the wing part 223*a* and the flap part 223*b* of each blade 223 are integrally formed as a single piece. Of course, the wing part 223*a* and the flap part 223*b* may also be provided separately. The connection between the wing part 223*a* and the flap part 223*b* may be touch connection, adhesive connection, pivotal connection, or adjacent connection. As shown in FIG. 5, the flap part 223*b*' is pivoted at one end of the wing part 223*a*'. Alternatively, as shown in FIG. 6, the flap part 223*b*" and the wing part 223*a*" are disposed apart from each other at a distance. Of course, the flap part may be directly in touch against one end of the wing part. It should be noted that the shapes of the wing part and the flap part are not limited in the present invention. The wing part and the flap part may have different shapes, different installation-angles. Alternatively, the front surface 223*c* of the blade formed by the wing part and the flap part may be a discontinuous plane or curved surface.

With further reference to FIG. 3, the fan 2 further includes a protecting cover 23 with a plurality of ribs 231. The protecting cover 23 can be locked on the frame 21 by four screws 28.

Practical test results show that, when the same motor provides the same rotating speed, the fan 2 has better airflow efficiency and delay the occurrence of stalling phenomenon in comparison with the conventional fan 1 at the same noise value and the same power consumption.

In addition to applications to the impeller 22, the structure of the wing part 223*a* and the flap part 223*b* may be used in other parts of the fan too.

Figure 7:
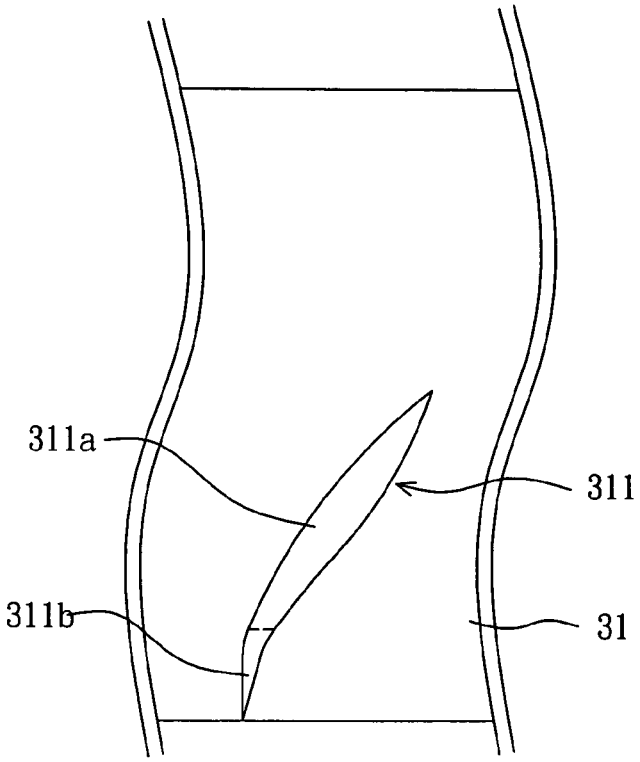
FIG. 7 is a schematic view showing a frame and a protecting cover according to a second embodiment of the present invention.

As shown in FIG. 7, a fan 3 according to a second embodiment of the present invention has a frame 31 and an impeller (not shown) disposed in the frame 31. The frame 31 has a plurality of stationary blades 311, each of the stationary blades 311 has a wing part 311*a* and a first flap part 311*b*. The structure of the wing part 311*a* and the first flap part 311*b* has the same constructions and functions as those in the first embodiment. Therefore, they are not further described herein.

Figure 8:
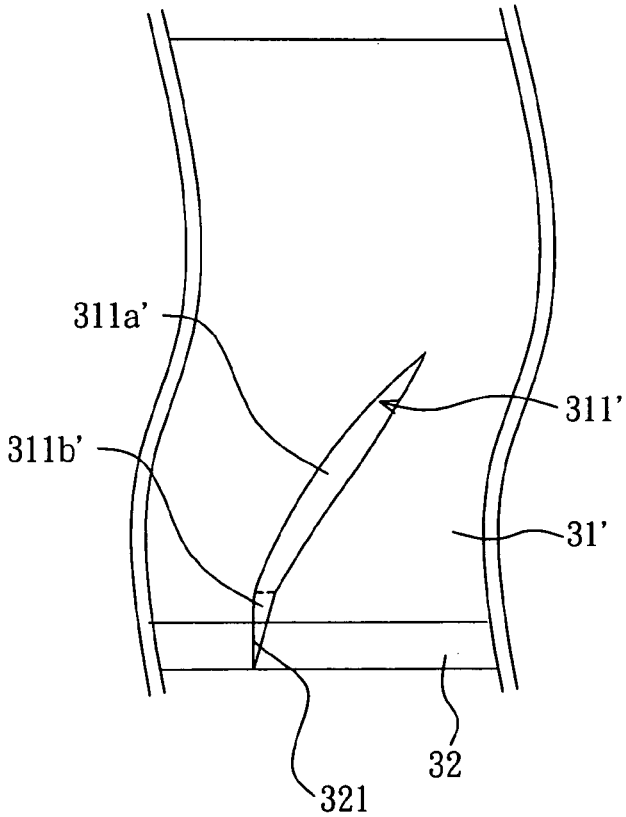
FIG. 8 is another schematic view showing the frame and protecting cover according to the second embodiment of the present invention.

As shown in FIG. 8, the fan 3 further includes a protecting cover 32 detachably assembled with the frame 31'. In this embodiment, the frame 31 has a wing part 311*a*' and a first flap part 311*b*' as those in FIG. 7, the protecting cover 32 further has a plurality of second flap parts 321, each of the second flap parts 321 is a rib of the protecting cover 32. Each of the second flap parts 321 is disposed corresponding to the first flap part 311*b*'. The first flap part 311*b*' together with the second flap part 321 form a complete wing. Moreover, the connection between the wing part 311*a*', the first flap part 311*b*' and the second flap part 321 may be touch connection, adhesive connection, pivotal connection, adjacent connection, or disposed apart from each other at a distance.

Figure 9:
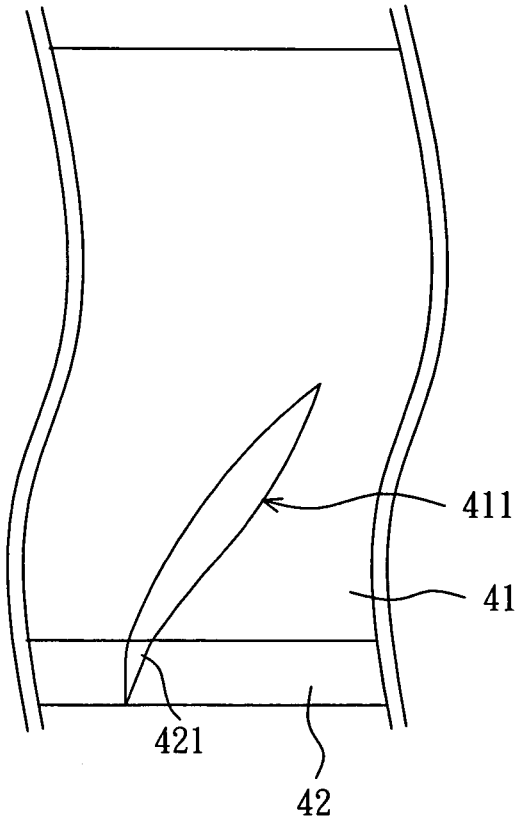
FIG. 9 is a schematic view showing a frame and a protecting cover according to a third embodiment of the present invention.

As shown in FIG. 9, a fan 4 according to a third embodiment of the present invention includes a frame 41, an impeller (not shown) disposed in the frame 41, and a protecting cover 42 connected to the frame 41. The frame 41 has a plurality of wing parts 411, each of the wing parts 411 is the stationary blade of the frame 41. The protecting cover 42 has a plurality of flap parts 421, each of the flap parts 421 is a rib of the protecting cover 42. Therefore, once the protecting cover 42 is combined with the frame 41, the wing parts 411 are respectively disposed corresponding to the flap parts 421. Likewise, the connection between the wing part 411 and the flap part 421 may be touch connection, adhesive connection, pivotal connection, or adjacent connection.

Since the wing parts and the flap parts are respectively disposed on the frame or protecting cover, the airflow can be blown out more smoothly without affecting the airflow efficiency of the fan.

Figure 10:
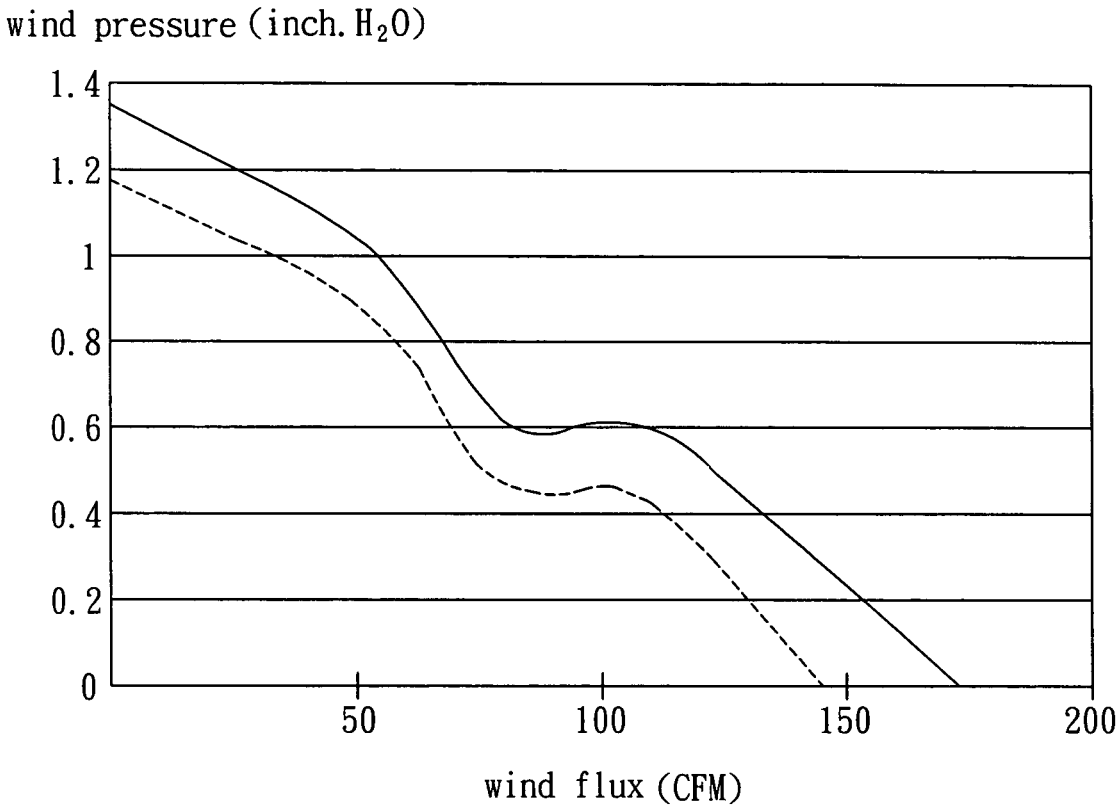
FIG. 10 is the characteristic curves showing wind pressure versus wind flux of the fan according to the present invention and a conventional fan.

As shown in FIG. 10, the vertical axis indicates the wind pressure and the horizontal axis indicates the wind flux. The dashed line is the result of a conventional fan, and the solid line represents the fan according to the present invention. For the same wind flux, the fan according to the present invention has a larger wind pressure and increases the airflow efficiency by more than 5%.

The present invention also provides a fan blade including a wing part and a flap part. The flap part is connected to the wing part, and the wing part and the flap part form a predetermined angle.

In summary, due to the flap part is connected to the wing part, and the wing part and the flap part form a first predetermined angle. Comparing with the prior art, a fan and a blade thereof according to the present invention can enhance the airflow efficiency, prevent installing phenomenon from happening, and reduce the noises during operations. Moreover, in addition to the impeller of the fan, the structure of the wing part and the flap part can be disposed in the flame or protecting cover to enhance the airflow efficiency and the product quality.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan comprising:

a frame having a plurality of stationary blades, wherein each stationary blade has a wing part and a first flap part, and the wing part and the first flap part form a predetermined angle, wherein the ratio of the axial length of the first flap parts to the axial length of the stationary blades is less than 0.75; and an impeller disposed in the frame.

2. The fan according to claim 1, further comprising a protecting cover connected to the frame, wherein the protecting cover has a plurality of second flap parts respectively corresponding to the first flap parts to form a complete wing.

3. The fan according to claim 2, wherein the shape of the complete wing is curved or flat.

4. The fan according to claim 2, wherein the shapes or the installation-angles of the wing part and the complete wing are different.

5. The fan according to claim 1, wherein the stationary blade further comprises a front surface that is a discontinuous plane or curved surface.

6. The fan according to claim 1, wherein the shapes or the installation-angles of the wing part and the first flap part are different.

7. A fan comprising:

a frame having a plurality of wing parts;

an impeller disposed in the frame; and a protecting cover detachably assembled with the frame and having a plurality of flap parts respectively corresponding to the wing parts, wherein the wing part and the flap part form a predetermined angle.

8. The fan according to claim 7, wherein the wing part and the flap part form a blade with a front surface that is a discontinuous plane or curved surface.

9. The fan according to claim 7, wherein the shapes or the installation-angles of the wing part and the flap part are different.

10. A fan comprising:

a frame having a plurality of first flap parts; and an impeller disposed in the frame and having a plurality of rotor blades, wherein the rotor blade and the first flap part form a predetermined angle, wherein the ratio of the axial length of the first flap parts to the axial length of the rotor blades is less than 0.75.

11. The fan according to claim 10, wherein the shapes or the installation-angles of the rotor blade and the first flap part are different.

12. The fan according to claim 10, further comprising a protecting cover connected to the frame, wherein the protecting cover has a plurality of second flap parts respectively corresponding to the first flap parts to form a complete wing.

* * * * *